US006536517B2

(12) United States Patent
Hoshino et al.

(10) Patent No.: US 6,536,517 B2
(45) Date of Patent: Mar. 25, 2003

(54) EVAPORATOR

(75) Inventors: Ryoichi Hoshino, Oyama (JP); Noboru Ogasawara, Oyama (JP); Hirofumi Horiuchi, Oyama (JP); Hiroyasu Shimanuki, Kariya (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 09/886,605

(22) Filed: Jun. 22, 2001

(65) Prior Publication Data

US 2002/0020521 A1 Feb. 21, 2002

(30) Foreign Application Priority Data

Jun. 26, 2000 (JP) ..... 2000-190554

(51) Int. Cl.[7] ..... F28F 9/22

(52) U.S. Cl. ..... 165/176; 165/173; 165/174; 165/175

(58) Field of Search ..... 165/152, 174, 165/173, 175, 176, 153; 62/515, 524, 525, 526

(56) References Cited

U.S. PATENT DOCUMENTS

| | | | | | |
|---|---|---|---|---|---|
| 4,332,293 | A | * | 6/1982 | Hiramatsu | 165/153 |
| 4,615,384 | A | * | 10/1986 | Shimada et al. | 165/152 |
| 5,311,935 | A | * | 5/1994 | Yamamoto et al. | 165/152 |
| 5,931,226 | A | * | 8/1999 | Hirano et al. | 165/170 |
| 6,199,401 | B1 | * | 3/2001 | Haussmann | 165/153 |
| 6,272,881 | B1 | * | 8/2001 | Kuroyanagi et al. | 165/153 |

* cited by examiner

*Primary Examiner*—Allen Flanigan
(74) *Attorney, Agent, or Firm*—Armstrong, Westerman & Hattori, LLP

(57) ABSTRACT

An evaporator comprises a pair of upper and lower horizontal header tanks, a group of heat exchange tubes arranged laterally of the evaporator in front and rear two rows and each connected to the upper header tank and the lower header tank respectively, and a vertical partition wall provided inside the upper header tank and extending laterally of the evaporator so as to form sectioned header chambers for causing a refrigerant to flow through each pair of front and rear adjacent heat exchange tubes in directions opposite to each other. An inlet is provided for a liquid-vapor mixture refrigerant in a sectioned rear header chamber, and an outlet is provided for vaporized refrigerant in a sectioned front header chamber. The evaporator is 3 to 30% in channel opening ratio.

7 Claims, 5 Drawing Sheets

EVAPORATOR

BACKGROUND OF THE INVENTION

The present invention relates to evaporators, and more particularly to evaporators for use in car coolers.

Throughout the specification and the appended claims, the term "front" refers to the side of the evaporator at which air flows thereinto between the heat exchange tubes thereof, the term "rear" to the side at which the air flows out from between the heat exchange tubes, and the terms "left" and "right" are used for the evaporator as it is seen from the front. Further the term "aluminum" includes pure aluminum and aluminum alloys.

FIG. 8 shows a conventional evaporator 30, which comprises a pair of upper and lower horizontal header tanks 31, 32 each having a horizontally elongated, approximately rectangular cross section and opposed to each other at a spacing, a group of heat exchange tubes 33A, 33B, 34A, 34B arranged in front and rear two rows and each in the form of a flat tube, the tubes being arranged leftward or rightward and each connected to the upper header tank 31 and the lower header tank 32 respectively at its upper and lower ends in communication with the tanks, a first vertical partition wall 35 provided in the upper header tank 31 at the midportion of its length and extending from the front rearward, a second vertical partition wall 36 extending from the left rightward and disposed in the left half of the upper header tank 31 separated by the partition wall 35, the partition wall 36 being disposed at the midportion of width of the tank 31, and a third vertical partition wall 37 disposed in the lower header tank 32 at the midportion of width thereof and extending from the left rightward. The interior of the upper header tank 31 is divided into an upper left rear half header chamber, an upper left front half header chamber, and an upper right half header chamber by the first and second vertical partition walls 35, 36. The interior of the lower header tank 32 is divided into a lower rear header chamber and a lower front header chamber by the third vertical partition wall 37. An inlet 38 for a liquid-vapor mixture refrigerant R1 is provided at one end of the upper left rear half header chamber at the side from which cooled air A2 flows out after passing between the heat exchange tubes 33A, 33B, 34A, 34B, whereby the upper left rear half header chamber is made to serve as a refrigerant inflow header chamber 39. An outlet 40 for vaporized refrigerant R2 is provided at one end of the upper left front half header chamber at the side where the air A2 to be cooled flows in between the heat exchange tubes 33A, 33B, 34A, 34B, whereby the upper left front half header chamber is made to serve as a refrigerant outflow header chamber 41. The lower rear header chamber serves as a first intermediate header chamber 42, the upper right half header chamber as a second intermediate header chamber 43, and the lower front header chamber as a third intermediate header chamber 44. Corrugated fins 45 are provided between the heat exchange tubes 33A, 33B, 34A, 34B which are adjacent to one another laterally of the evaporator.

With the conventional evaporator 30 described, the liquid-vapor mixture refrigerant R1 entering the refrigerant inflow header chamber 39 from the inlet 38 flows down the heat exchange tubes 34A in the left half of the rear row from the header chamber 39, reaches the left half of the first intermediate header chamber 42 and flows into the right half of the same header chamber 42. The refrigerant then ascends the heat exchange tubes 34B in the right half of the rear row from the right half of the chamber 42, reaches the rear half of the second intermediate header chamber 43 and flows into the front half of the same header chamber 43. The refrigerant thereafter descends the heat exchanger tubes 33A in the right half of the front row from the front half of the chamber 43, reaches right half of the third intermediate header chamber 44 and flows into the left half of the same header chamber 44. Finally the refrigerant ascends the heat exchange tubes 33B in the left half of the front row, reaches the refrigerant outflow header chamber 41 and flows out of the outlet 40 in the form of vaporized refrigerant R2.

The refrigerant flowing through the heat exchange tubes 33B communicating with the outflow header chamber 41 is in the form of an almost complete vapor, whereby super heat is available as required. Since the refrigerant is a vapor, however, the heat exchange tubes 33B are lower in heat exchange ability than the other heat exchange tubes 34A, 34B, 33A wherein the refrigerant flows in a vapor-liquid two-phase state. Accordingly, the air after flowing between the heat exchange tubes 33B in the left half of the heat exchanger 30 and between the heat exchange tubes 34A in the left half has a higher temperature than the air after flowing between the heat exchange tubes 33A in the right half of the heat exchanger 30 and between the heat exchange tubes 34B in the right half. As a result, the conventional evaporator 30 has the problem that the air A2 cooled thereby, i.e., the air discharged from the evaporator, is uneven in temperature distribution.

An object of the present invention is to provide an evaporator which is uniform in the temperature distribution of the air discharged from the evaporator.

SUMMARY OF THE INVENTION

The present invention provides an evaporator for fulfilling the above object, the evaporator comprising a pair of upper and lower horizontal header tanks opposed to each other at a spacing, a group of heat exchange tubes arranged laterally of the evaporator in front and rear two rows and each connected to the upper header tank and the lower header tank respectively at upper and lower ends thereof in communication with the tanks, and a vertical partition wall provided inside one of the header tanks and extending laterally of the evaporator so as to form sectioned header chambers for causing a refrigerant to flow through each pair of front and rear adjacent heat exchange tubes in directions opposite to each other, an inlet being provided for a liquid-vapor mixture refrigerant in a sectioned rear header chamber at an evaporator side from which cooled air flows out after passing between the heat exchange tubes to thereby make the sectioned rear header chamber serve as a refrigerant inflow header chamber, an outlet being provided for a vaporized refrigerant in a sectioned front header chamber at an evaporator side where the air to be cooled flows in between the heat exchange tubes to thereby make the sectioned front header chamber serve as a refrigerant outflow header chamber, the evaporator being 3 to 30% in channel opening ratio which is a value obtained by dividing the total cross sectional area of refrigerant channels in one heat exchange tube by the area of the horizontal section of the refrigerant inflow header chamber per heat exchange tube in the inflow header chamber and along openings of the heat exchange tube therein.

The air discharged from the evaporator has a uniform temperature distribution insofar as the liquid portion of the liquid-vapor mixture refrigerant is uniformly distributed as will be described below to the heat exchange tubes arranged in the rear row and connected to the refrigerant inflow header chamber. The refrigerant becomes a vapor within the heat exchange tubes in the front row after passing through the heat exchange tubes in the rear row and enters the refrigerant outflow header chamber after being superheated. Accordingly, the refrigerant is superheated uniformly in all the heat exchange tubes in the front row, with the result that the air passing between the heat exchange tubes in the front row and between those in the rear row is uniformly cooled in its entirely to ensure comfortable air conditioning.

Since the liquid portion of the liquid-vapor mixture refrigerant vaporizes by absorbing heat from outside, it is most important to distribute the liquid portion uniformly to the heat exchange tubes in the rear row. It has been found that the distribution of the liquid portion to the heat exchange tubes in the rear row is greatly influenced by the channel opening ratio which is a value obtained by dividing the total cross sectional area of the refrigerant channels in one heat exchange tube by the area of the horizontal section of the refrigerant inflow header chamber per heat exchange tube in the inflow header chamber and along the openings of the heat exchange tube therein. The channel opening ratio suitable for uniformly distributing the liquid portion of the liquid-vapor mixture refrigerant to the heat exchange tubes in the rear row is 3 to 30%. If the ratio is over 30%, the liquid portion of the refrigerant which portion is great in density and mass concentrically collects at the end portion of the refrigerant inflow header chamber which end portion is remote from the inlet to flow into the heat exchange tubes in the remote end portion due to the force of inertia of the liquid portion flow, while the vapor portion of the refrigerant, which is smaller in inertia force than the liquid portion thereof and fails to contributes greatly to the cooling of air, flows into the heat exchange tubes in the region other than the end portion to result in a deficiency of the liquid portion in this region. Accordingly, heat exchange can not be attained as intended. When the channel opening ratio is 3 to 30%, the liquid portion of the refrigerant temporarily collects owing to the force of inertia of the flow thereof to the end portion of the inflow header chamber remote from the inlet, whereas since the channel opening ratio is then smaller than in the above case, the liquid portion can not entirely flow into the openings of the channels in the remote end portion but partly flows reversely to the inlet side, with the result that the liquid portion is uniformly distributed to the heat exchange tubes arranged in the rear row and connected to the refrigerant inflow header chamber. If the channel opening ratio is less than 3%, increased flow resistance is offered to the refrigerant to result in an impaired heat exchange efficiency. The channel opening ratio within the range of 3 to 30% is preferably 3 to 20%, more preferably 4 to 10%.

Each pair of adjacent front and rear heat exchange tubes in the group of heat exchange tubes arranged in the front and rear two rows may be made integral by providing a joint portion therebetween.

Preferably, each of the heat exchange tubes comprises a flat tube comprising a pair of left and right walls each having a flat outer surface, and a plurality of reinforcing walls interconnecting the left and right walls and extending longitudinally of the tube, the reinforcing walls being spaced apart from one another by a predetermined distance, the flat tube having parallel refrigerant channels inside thereof and a left-to-right width smaller than the front-to-rear width thereof, at least one of the left and right walls being provided on an inner surface thereof with a plurality of projections for producing a turbulent flow in the refrigerant flowing through the tube. The reinforcing walls afford an enhanced heat transfer property and increased pressure resistance. Being in the form of flat tubes each comprising left and right walls having a flat outer surface, the heat exchange tubes which are adjacent to one another in a leftward or rightward direction, i.e., laterally of the evaporator, can be provided with corrugated fins therebetween, with an air passing clearance formed between each pair of adjacent tubes. The projections for producing a turbulent flow in the refrigerant give the heat exchange tube an increased heat exchange efficiency.

Preferably, each of the reinforcing walls has a plurality of communication holes for holding the parallel refrigerant channels in communication with one another. The communication holes serve to mix together the refrigerant portions in the parallel refrigerant channels, giving an improved heat exchange efficiency to the heat exchange tube.

Preferably, the flat tube is 0.75 to 1.5 mm in left-to-right width. When the flat tube has a left-to-right width in this range,an increased number of flat tubes, i.e., of heat exchange tubes, can be arranged in the front and rear rows, while an increased number of fins can be provided for the air to be cooled. This serves to provide increased heat transfer areas and greatly diminish the resistance to the air. The diminished resistance to the air reduces the noise to be produced by the blower.

The present invention will be described in greater detail with reference to the accompanying drawings.

DESCRIPTION OF THE PREFERRED EMBODIMENTS

Figure 1:
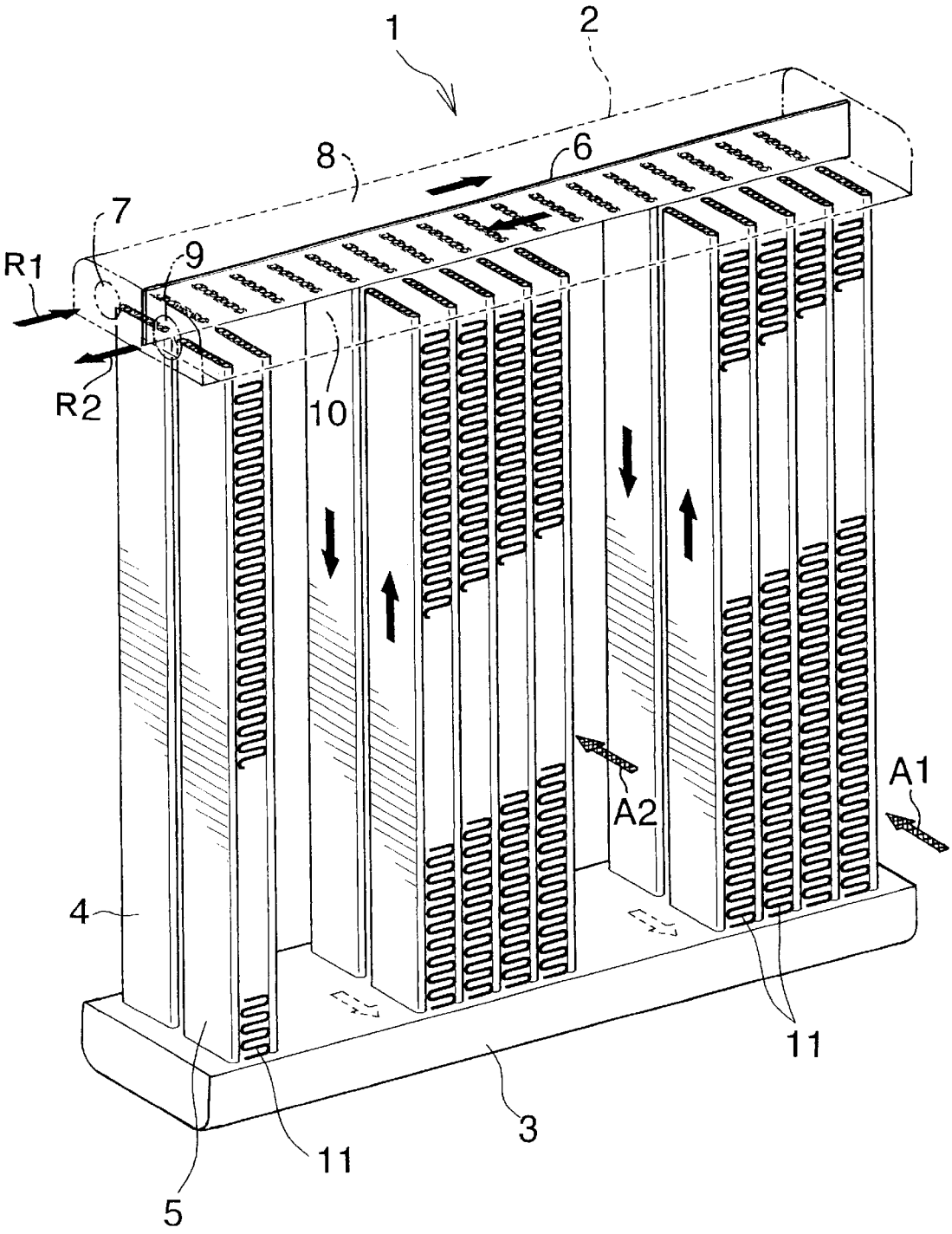
FIG. 1 is a perspective view of an evaporator embodying the present invention.

FIG. 1 shows an evaporator of the present invention in its entirety. The evaporator 1 is entirely made from aluminum and comprises a pair of upper and lower horizontal header tanks 2, 3 each having a horizontally elongated, approximately rectangular cross section and opposed to each other at a spacing, a group of heat exchange tubes 4, 5 arranged leftward or rightward (i.e., laterally of the evaporator) in front and rear two rows and each connected to the upper header tank 2 and the lower header tank 3 respectively at its upper and lower ends in communication with the tanks, and a vertical partition wall 6 provided inside the upper header tank 2 and extending laterally of the evaporator so as to form sectioned header chambers for causing a refrigerant to flow through each pair of front and rear adjacent heat exchange tubes in directions opposite to each other. An inlet 7 is provided for a liquid-vapor mixture refrigerant R1 in the sectioned rear header chamber at the evaporator side from which cooled air A2 flows out after passing between the heat exchange tubes 4, 5, whereby the sectioned rear header chamber is made to serve as a refrigerant inflow header chamber 8. An outlet 9 is provided for vaporized refrigerant R2 in the sectioned front header chamber at the evaporator side where the air A2 to be cooled flows in between the heat exchange tubes 4, 5, whereby the sectioned front header chamber is made to serve as a refrigerant outflow header chamber 10. The evaporator is in the range of 3 to 30% in channel opening ratio which is a value obtained by dividing the total cross sectional area of refrigerant channels in one heat exchange tube by the area of the horizontal section of the refrigerant inflow header chamber per heat exchange tube in the inflow header chamber and along the openings of the heat exchange tube therein. The heat exchange tubes 4, 5 are in the form of flat tubes of identical shape having a left-to-right width which is smaller than the front-to-rear width thereof. Corrugated fins 11 are interposed between each pair of heat exchange tubes 4 or 5 which are adjacent to each other laterally of the evaporator.

Figure 2:
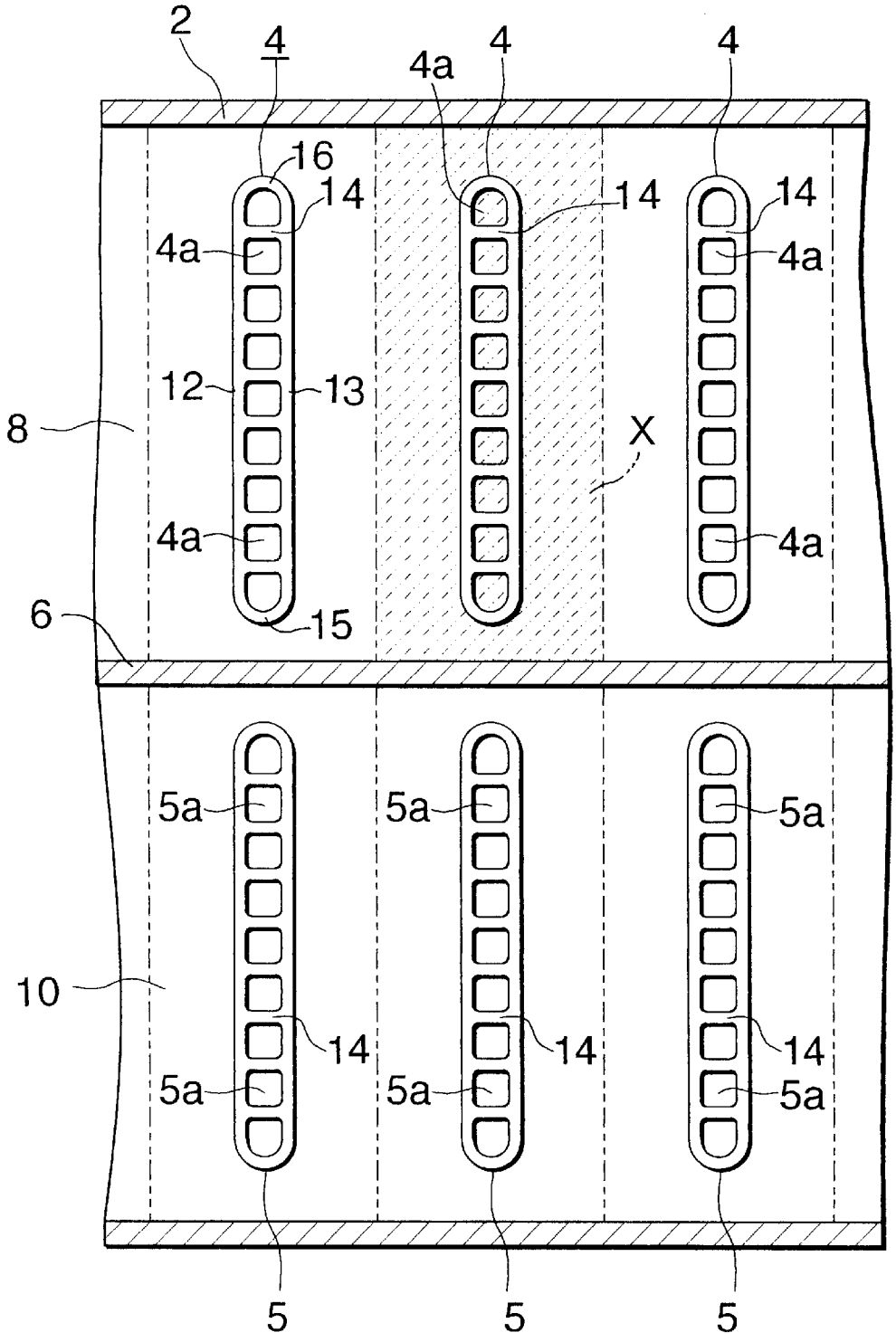
FIG. 2 is an enlarged fragmentary view in horizontal section of an upper header.

As shown in FIG. 2, each of the heat exchange tubes 4, 5 which is in the form of a flat tube comprises a pair of left and right walls 12, 13 each having a flat outer surface, and eight reinforcing walls 14 interconnecting the left and right walls 12, 13, extending longitudinally of the tube and spaced apart from one another by a predetermined distance. The heat exchange tube has parallel refrigerant channels 4*a* or 5*a* inside thereof. With reference to the same drawing, the expression "the total cross sectional area of refrigerant channels in one heat exchange tube" means the following. Since one heat exchange tube 4 has nine refrigerant channels 4*a*, the sum of the cross sectional areas of the nine channels 4*a* corresponds to the total cross sectional area of the refrigerant channels. Further with reference to FIGS. 1 and 2, the expression "the area of the horizontal section of the refrigerant inflow header chamber 8 per heat exchange tube in the inflow header chamber and along the openings of the heat exchange tube therein" means the following. The refrigerant inflow header chamber 8 has 18 heat exchange tubes 4 connected thereto, so that the area of the horizontal section of the refrigerant inflow header chamber 8 along the openings of the tubes 4 therein as divided by 18, i.e., the area of the hatched portion X shown in FIG. 2, corresponds to the area of the horizontal section of the refrigerant inflow header chamber 8 per heat exchange tube in the inflow header chamber and along the openings of the tube.

Figure 3:
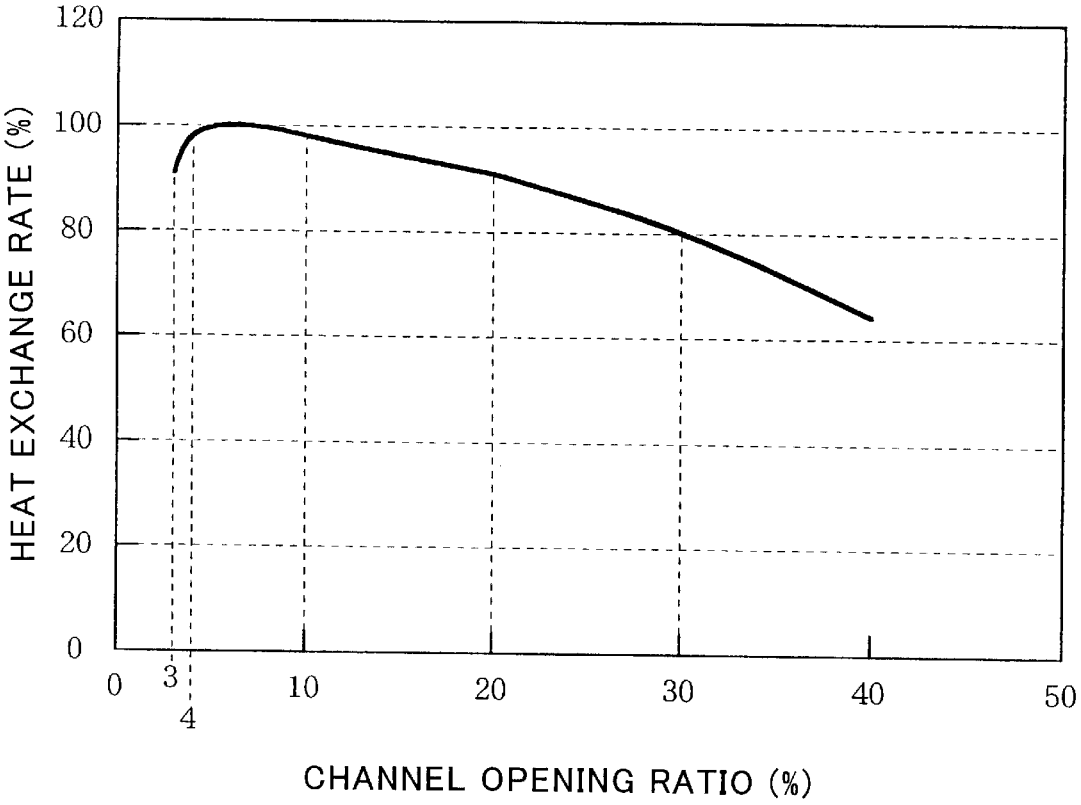
FIG. 3 is a graph showing the relationship between the channel opening ratio and the heat exchange rate.

FIG. 3 shows the relationship between the channel opening ratio and the heat exchange rate. The relationship shown in FIG. 3 was determined for an evaporator wherein the area of the horizontal section of the refrigerant inflow header chamber 8 per heat exchange tube 4 in the inflow header chamber 8 and along the openings of the tube 4 was 121.6 $mm^2$, using varying values for the total cross sectional area of refrigerant channels 4*a* in one heat exchange tube 4.

FIG. 3 reveals that a high heat exchange rate is available when the opening ratio is 3 to 30%. A more preferable result is available when the opening ratio is 3 to 20%. A further improved result is obtained at an opening ratio of 4 to 10%.

High heat exchange rates indicate that heat exchange is effected with a high efficiency in all the heat exchange tubes 4, 5 of the evaporator 1, also showing that the air discharged from the evaporator 1 is uniform in temperature distribution.

Figure 6:
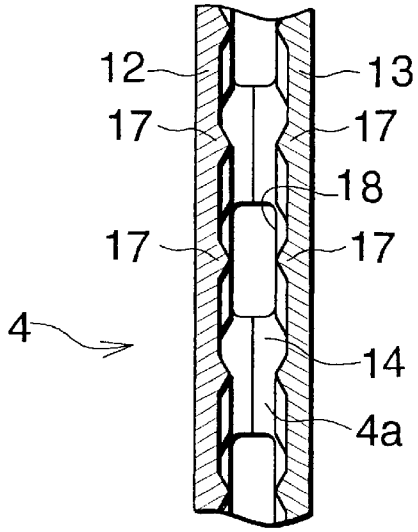
FIG. 6 is a fragmentary view in section taken along the line 6—6 in FIG. 4.
Figure 4:
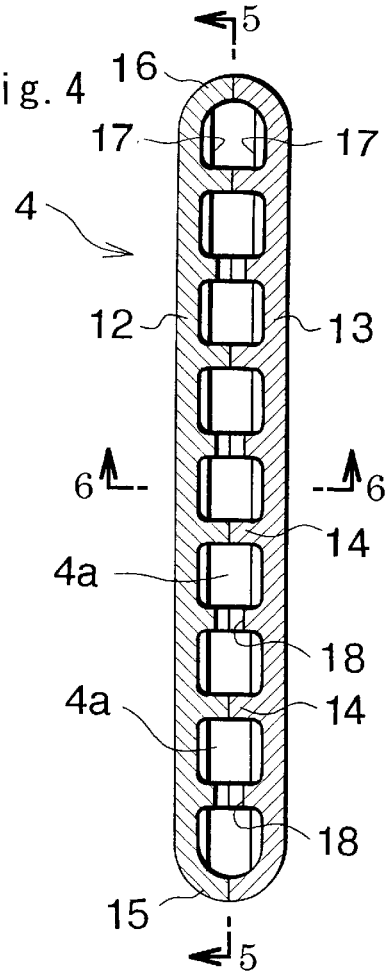
FIG. 4 is an enlarged detailed cross sectional view of a heat exchange tube.
Figure 5:
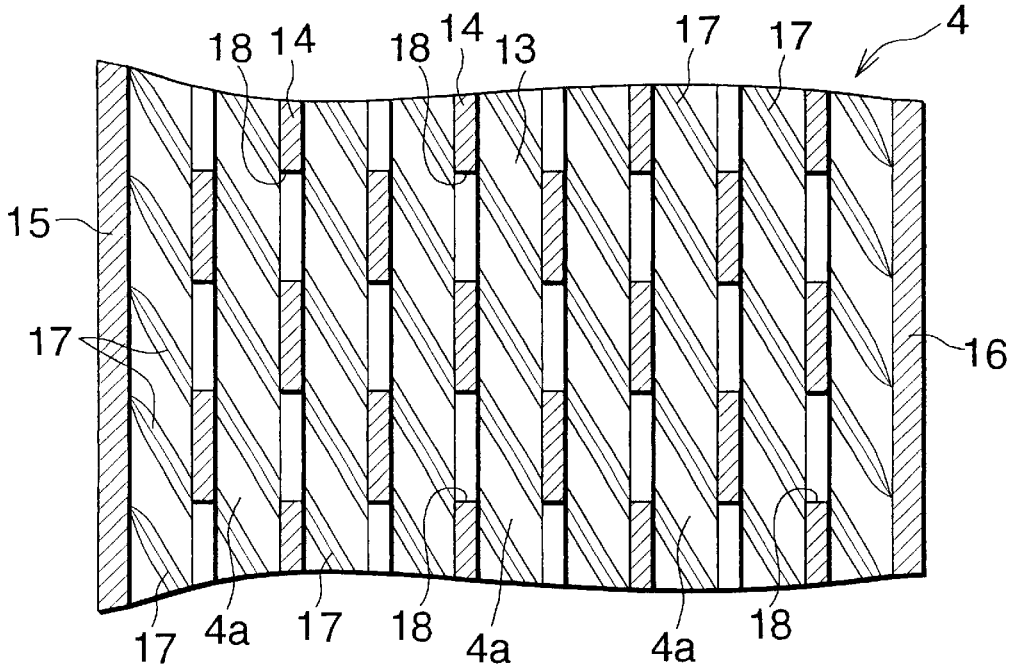
FIG. 5 is a view in section taken along the line 5—5 in FIG. 4.
Figure 8:
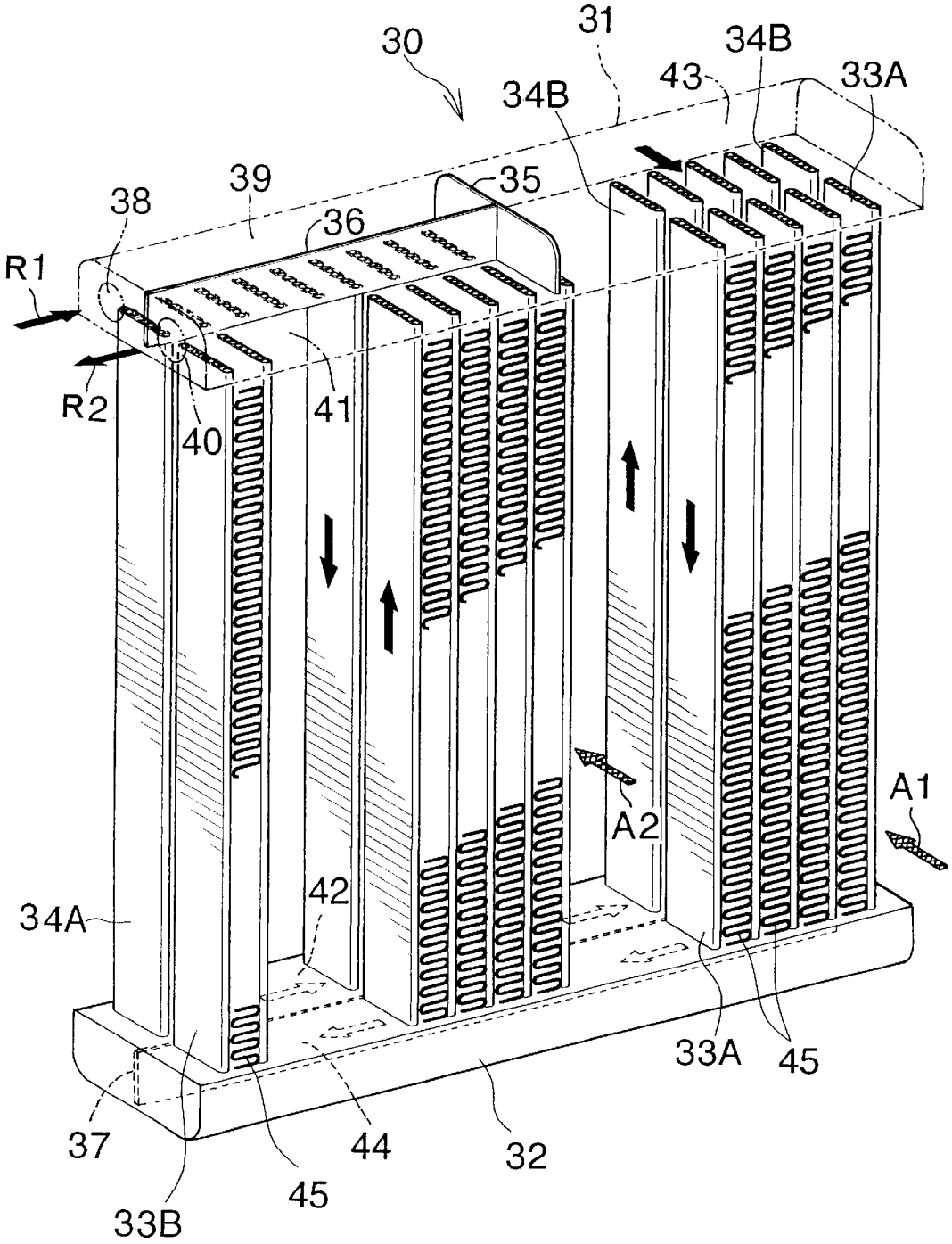
FIG. 8 is a perspective view of a conventional evaporator.

FIGS. 4 to 6 show the rear heat exchange tube 4 in greater detail. The front heat exchange tuber 5 is identical with the rear heat exchange tube 4. The heat exchange tube 4 in the form of a flat tube has front and rear walls 15, 16 each bulging in the form of a circular arc. The left and right walls 12, 13 are each provided on the inner surface thereof with projections 17 slanting forwardly downward and having a generally triangular cross section for producing a turbulent flow in the refrigerant flowing through the tube 4. The projections 17 are arranged vertically as spaced apart, and formed between each pair of adjacent reinforcing walls 14, between the front wall 15 and the reinforcing wall 14 adjacent thereto and between the rear wall 16 and the reinforcing wall 14 adjacent thereto. A plurality of communication holes 18 are formed in each reinforcing wall 14 for holding the parallel refrigerant channels 4*a* in communication with one another. The communication holes 18 are in a staggered arrangement over the entire arrangement of reinforcing walls 14. The heat exchange tube 4 is 0.75 to 1.5 mm in left-to-right width, and 12 to 18 mm in front-to-rear width. The tube 4 and the reinforcing walls 14 are 0.175 to 0.275 mm in wall thickness. The pitch of the reinforcing walls 14 is 0.5 to 3.0 mm. The bulging circular-arc front and rear walls 15, 16 each have a circular-arc contour which is 0.35 to 0.75 mm in radius of curvature.

With the evaporator 1 of the present invention, a liquid-vapor mixture refrigerant R1 is admitted into the refrigerant inflow header chamber 8 through the inlet 7 and then flows down the heat exchange tubes 4 in the rear row from the chamber 8 to reach the lower header tank 3. Subsequently the refrigerant ascends the heat exchange tubes 5 in the front row from the lower header tank 3, reaches the refrigerant outflow header chamber 10 and is discharged from the outlet 9 in the form of a vaporized refrigerant R2.

Figure 7:
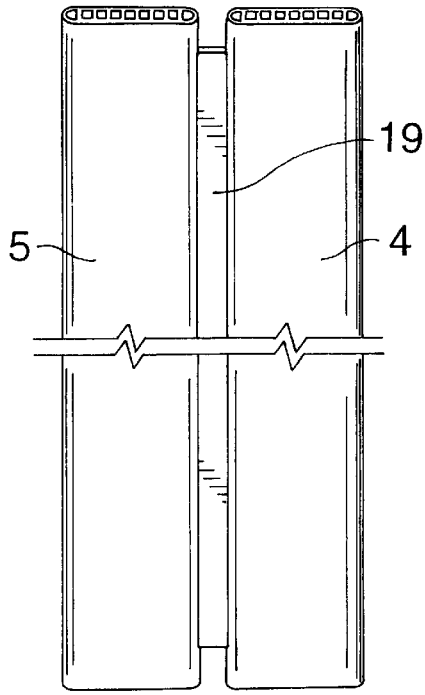
FIG. 7 is a perspective view showing two heat exchange tubes as made integral by a joint portion.

FIG. 7 shows front and rear two adjacent heat exchange tubes 5, 4 which are made integral by providing a joint portion 19 between the tubes. Such tubes are also usable. The heat exchange tubes 4, 5 may have corrugated inner fins inserted therein in place of the reinforcing walls, with the wave crest portions of the fins blazed to the tube inner surfaces. The inlet 7 and the outlet 9 provided in the inflow header chamber 8 and the outflow header chamber 10, each at one end of the chamber, may alternatively be provided each at an upper part of the lengthwise midportion of the corresponding chamber.

What is claimed is:

1. An evaporator comprising a pair of upper and lower horizontal header tanks opposed to each other at a spacing, a group of heat exchange tubes arranged laterally of the evaporator in front and rear two rows and each connected to the upper header tank and the lower header tank respectively at upper and lower ends thereof in communication with the tanks, and a single vertical partition wall provided inside one of the header tanks and extending laterally of the evaporator so as to form sectioned header chambers for causing a refrigerant to flow through each pair of front and rear adjacent heat exchange tubes in directions opposite to each other, an inlet being provided for a liquid-vapor mixture refrigerant in a sectioned rear header chamber at an evaporator side from which cooled air flows out after passing between the heat exchange tubes to thereby make the sectioned rear header chamber serve as a refrigerant inflow header chamber, an outlet being provided for a vaporized refrigerant in a sectioned front header chamber at an evaporator side where the air to be cooled flows in between the heat exchange tubes to thereby make the sectioned front header chamber serve as a refrigerant outflow header chamber, the evaporator being 3 to 30% in channel opening ratio which is a value obtained by dividing the total cross sectional area of refrigerant channels in one heat exchange tube by the area of the horizontal section of the refrigerant inflow header chamber per heat exchange tube in the inflow header chamber and along openings of the heat exchange tube therein.

2. An evaporator according to claim 1 which is 3 to 20% in channel opening ratio.

3. An evaporator according to claim 1 which is 4 to 10% in channel opening ratio.

4. An evaporator according to claim 1 wherein the adjacent front and rear heat exchange tubes in each pair in the group of heat exchange tubes arranged in the front and rear two rows are made integral by providing a joint portion therebetween.

5. An evaporator according to claim 1 wherein each of the heat exchange tubes comprises a flat tube comprising a pair of left and right walls each having a flat outer surface, and a plurality of reinforcing walls interconnecting the left and right walls and extending longitudinally of the tube, the reinforcing walls being spaced apart from one another by a predetermined distance, the flat tube having parallel refrigerant channels inside thereof and a left-to-right width smaller than the front-to-rear width thereof, at least one of the left and right walls being provided on an inner surface thereof with a plurality of projections for producing a turbulent flow in the refrigerant flowing through the tube.

6. An evaporator according to claim 5 wherein each of the reinforcing walls has a plurality of communication holes for holding the parallel refrigerant channels in communication with one another.

7. An evaporator according to claim 5 wherein the flat tube is 0.75 to 1.5 mm in left-to-right width.

* * * * *